United States Patent [19]

Hosaka

[11] 4,385,596

[45] May 31, 1983

[54] FUEL SUPPLY CONTROL SYSTEM FOR AN INTERNAL COMBUSTION ENGINE

[75] Inventor: Akio Hosaka, Yokohama, Japan

[73] Assignee: Nissan Motor Company, Limited, Yokohama, Japan

[21] Appl. No.: 169,823

[22] Filed: Jul. 17, 1980

[30] Foreign Application Priority Data

Jul. 19, 1979 [JP] Japan ..... 54-90930
Jul. 19, 1979 [JP] Japan ..... 54-90931

[51] Int. Cl.[3] ..... F02D 5/02

[52] U.S. Cl. ..... 123/488; 123/325; 123/489; 123/491; 123/492; 123/493

[58] Field of Search ..... 123/492, 493, 486, 488, 123/491, 489, 325

[56] References Cited

U.S. PATENT DOCUMENTS

| | | | |
|---|---|---|---|
| 3,794,003 | 2/1974 | Reddy | 123/325 |
| 4,010,717 | 3/1977 | Taplin | 123/492 |
| 4,127,086 | 11/1978 | Harada et al. | 123/493 |
| 4,143,622 | 3/1979 | Klötzner et al. | 123/492 |
| 4,143,623 | 3/1979 | Norimatsu et al. | 123/493 |
| 4,184,458 | 1/1980 | Aoki et al. | 123/492 |
| 4,186,691 | 2/1980 | Takase et al. | 123/325 |
| 4,221,193 | 9/1980 | Ezoe et al. | 123/493 |

*Primary Examiner*—Charles J. Myhre
*Assistant Examiner*—Andrew M. Dolinar
*Attorney, Agent, or Firm*—Schwartz, Jeffery, Schwaab, Mack, Blumenthal & Koch

[57] ABSTRACT

Disclosed is a fuel supply control system for controlling fuel amount to be supplied to an internal combustion engine including a sensor means for detecting engine load condition and other control parameters and generating sensor signals, an arithmetic means for determining a basic pulse width of a pulse signal indicative of basic fuel amount to be supplied, a means for correcting the basic pulse width of the pulse signal corresponding to various control parameter respectively indicative of engine conditions such as engine coolant temperature and a means for distinguishing engine driving condition based on inputs one of which is sensor signal indicative of engine load condition and generating correction command indicative of correction coefficient. The correction command is applied to the correction means to effect the same to increase or decrease the pulse width of the pulse signal or shut off the fuel supply to the engine.

18 Claims, 7 Drawing Figures

FUEL SUPPLY CONTROL SYSTEM FOR AN INTERNAL COMBUSTION ENGINE

BACKGROUND OF THE INVENTION

The present invention relates generally to a control system for fuel supply to an internal combustion engine. More specifically, the present invention relates to a fuel supply control system which determines a basic fuel amount to be supplied to the internal combustion engine and corrects the basic fuel amount to corresponding to engine load conditions.

Recently, there have been developed various control systems for controlling the fuel supply to an internal combustion engine such as, for example, a reciprocating combustion engine mounted on an automotive vehicle. Such a control system is extremely important to maximize efficiency and fuel economy and minimize the emission from the engine of noxious pollutants. For accomplishing these requirements, recent control systems for fuel supply include the operation of shutting off the fuel supply while the vehicle is decelerating. For shutting off the fuel supply in response to deceleration of the vehicle, it is necessary to detect a decelerating condition of the vehicle effectively and satisfactorily. In a conventional control system, deceleration or acceleration of the vehicle have been determined by detecting the closing or opening of a throttle valve provided in an air intake passage, the throttle valve being mechanically connected to an accelerator pedal so as to be incorporated therewith. For detecting the closing or opening of the throttle valve, a throttle angle sensor or accelerator pedal switch has been employed in the control system. The throttle angle sensor generates a sensor signal when the throttle valve is in the fully closed position. The accelerator pedal switch also generates a signal when the accelerator pedal is in the fully released position. For detecting accelerating and decelerating conditions of the vehicle accurately, the throttle angle switch and the accelerator pedal switch are required to work correctly and accurately.

The point where the throttle valve moves from the fully closed position to an opened position is quite delicate and is apt to vary from one vehicle to another according to the exact position in which the engine is mounted. The throttle valve is determined as opened when it has rotated 1 or 2 degrees from the fully closed position. In other words when the accelerator pedal is just slightly applied. Thus, it is necessary to adjust the throttle angle switch or the accelerator pedal switch after assembly into the vehicle so that it may operate exactly and effectively to detect the fully closed position of the throttle valve and thereby detect decelerating conditions of the vehicle and generate a signal in response to deceleration of the vehicle. This adjusting operation after assembly of the vehicle is quite troublesome and also increases the number of operations in the assembly operation for the vehicle which results in a lower efficiency of manufacture of the vehicle. Further, the mechanical parts of the sensor or switch are liable to breakage or wear by repeatedly being brought into contact and then separated. This may cause displacement of the switching point and also mis-contacting between the switch elements to result in malfunctions of the control system. To avoid such a possibility, it is necessary to check the system, particularly the switch or sensor, at regular intervals.

Furthermore, since the conventional system detects the decelerating and accelerating conditions of the vehicle by detecting whether the throttle angle switch or accelerator pedal switch is on or off, it is impossible to accurately and effectively respond to engine driving conditions. Particularly, conventional control system can distinguish only whether the engine driving condition is adapted to fuel supply shut off, and are not adapted to correct the fuel supply amount corresponding to the vehicle driving condition; i.e., decreasing the fuel amount under decelerating conditions of the vehicle and increasing of the fuel amount under vehicle accelerating conditions.

Moreover, it will be beneficial and economical if the decelerating and accelerating conditions of the vehicle can be detected without using the above-mentioned throttle angle switch or accelerator pedal switch; will make manufacture of a vehicle including such a fuel supply control system easier. Also, it will increase efficiency and accuracy of the control system if the detecting means for detecting the deceleration and acceleration of the vehicle does not use elements requiring high accuracy or delicate adjustment for assembly.

SUMMARY OF THE INVENTION

Therefore, it is an object of the present invention to provide a fuel supply control system which does not include a throttle angle sensor or an accelerator pedal switch and employs other elements for detecting deceleration and acceleration of the vehicle, and in which the elements do not require a high accuracy of operation or a delicate relationship to other elements.

Another and more specific object of the present invention is to provide a fuel supply control system which can correct a basic fuel amount determined by the engine speed, in accordance with a deceleration conditions or acceleration condition of the vehicle and also corresponding to the engine load conditions.

To accomplish the above-mentioned and other objects of the present invention, there is provided a fuel supply control system includes sensor means for detecting engine load condition and other control parameters and generating sensor signals, an arithmetic means for determining a basic pulse width of a pulse signal indicative of basic fuel amount to be supplied, a means for correcting the basic pulse width of the pulse signal corresponding to various control parameter such as engine coolant temperature and a means for distinguishing engine driving conditions based on inputs, one of which is a sensor signal indicative of engine load, and generating a correction command indicative of a correction coefficient. The correction command is applied to the correction means to effect it to increase or decrease the pulse width of the pulse signal or to shut off the fuel supply to the engine.

Additional objects and advantages of the present invention will become apparent from the description and detailed explanation of the invention which follows.

BRIEF DESCRIPTION OF THE DRAWINGS

The present invention will become more fully understood from the detailed description given below, and the accompanying drawings of the preferred embodiments of the present invention, which, however, are not to be take as limitative of the present invention in any way, but are for the purpose of illustration and explanation only.

DESCRIPTION OF THE PREFERRED EMBODIMENT

Figure 1:
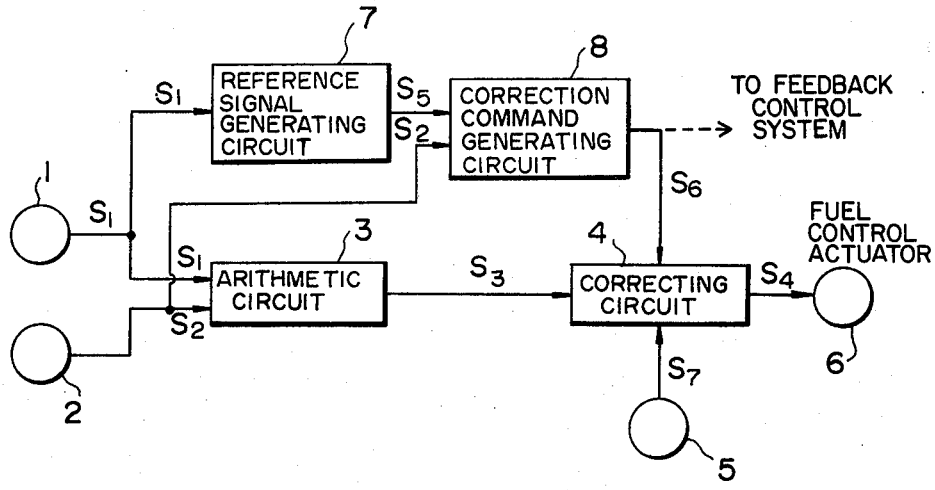
FIG. 1 is a schematic block diagram of one embodiment of a fuel supply control system according to the present invention.

Referring now to the drawings, and particularly to FIG. 1, there is illustrated a fuel supply control system for an internal combustion engine of for example an automotive vehicle in accordance with the present invention. In FIG. 1, reference numeral 1 denotes an engine speed sensor for determining the engine speed and generating a sensor signal $S_1$ indicative of the determined engine speed. This may be, for example, a crank angle sensor which generates a pulse signal having a frequency or pulse intervals proportional or inversely proportional to the engine speed.

Reference numeral 2 denotes a engine load sensor generating an engine load signal $S_2$. As the load sensor 2, an air flow meter for determining intake air amount can be used. Also, as the load sensor 2, a means for determining and generating signals corresponding to a determined intake vacuum, throttle valve angle or engine torque can be used.

The sensor signals $S_1$ and $S_2$ are inputted to an arithmetic circuit 3. Using the sensor signals $S_1$ and $S_2$, the arithmetic circuit 3 calculates a basic fuel supply amount and generates a signal $S_3$ indicative of the basic control ratio corresponding to the determined fuel injection amount (hereinafter referred as "basic signal $S_3$"). Generally, the value of the basic signal $S_3$ is obtained for example by:

$$S_3 = K(Q/N)$$

where N represents engine speed, Q represents an air intake amount and K is a constant.

The basic signal $S_3$ is fed to a correcting circuit 4 to determine the fuel supply amount according to a coolant temperature signal $S_7$ and other control parameters fed from a coolant temperature sensor 5 and others and generating a signal $S_4$ having a pulse width indicating the corrected fuel supply amount. The signal $S_4$ is supplied to an actuator 6 to control the energized and deenergized periods thereof in accordance with the duty factor. Generally, the actuator 6 is a fuel injection valve, fuel pump or the like.

The engine speed signal $S_1$ is also fed into a reference signal generating circuit 7. The reference signal generating circuit generates a reference signal $S_5$ which has a given functional relationship with the engine speed signal $S_1$. The reference signal $S_5$ is inputted to a correction command generating circuit 8. The engine load signal $S_2$ is also inputted to the correction command generating circuit 8 to be compared with the reference signal $S_5$. The correction command generating circuit 8 generates a correction command $S_6$ according to the difference between the engine load signal $S_2$ and the reference signal $S_5$. The correction command $S_6$ is fed to the correcting circuit 4 to control the circuit 4. It will also be possible to provide a correction circuit operative in response to the correction command $S_6$ fed from the correction command generating circuit 7. In this case, the circuit for correcting the fuel supply amount responsive to the correction command is of course incorporated in the correcting circuit 4.

Figure 2:
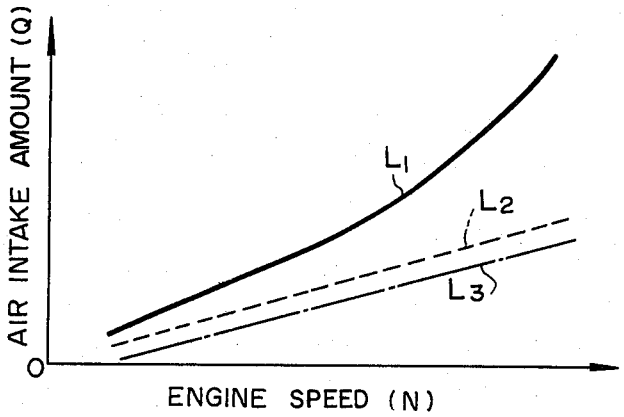
FIG. 2 is a graph showing a relationship between an air intake amount and engine speed, wherein each area defined by the curves illustrated in the graph show the decelerating, normal and accelerating condition of the vehicle driving.

FIG. 2 illustrates the relationship between the engine speed N and air intake amount Q. The solid line $L_1$ illustrates variation of air intake amount Q according to engine speed N in normal driving conditions on a level road. As seen from FIG. 2, at relatively low engine speeds, the air intake amount Q is substantially proportional to the engine speed N, but at higher engine speeds, the air intake amount Q is a non-linear function of the engine speed N, since at higher engine speeds, the engine loss is increased. The portion of the Q-N plane above the curve $L_1$ is in a range of relatively high engine load, e.g. acceleration conditions or driving uphill. On the other hand, the portion of the Q-N plane below the curve $L_1$ is a range of relatively low engine load, e.g. decelerating or driving downhill. The broken line $L_2$ shows variations of air intake amount Q according to the engine speed N when the engine output torque is zero. The portion of the Q-N plane below the curve $L_2$ represents the condition wherein the engine is driven by vehicle wheel rotation. The dot-dash line $L_3$ defines an area there which the fuel can be cut off. The value of the reference signal $S_5$ will vary substantially along the curve $L_3$. Therefore, if the load signal $S_2$ that is being compared with the reference signal $S_5$ in the correction command generating circuit 8, is lower than the reference signal $S_5$, the fuel supply is cut off and if the load signal $S_2$ becomes larger than the reference signal $S_5$, the fuel is resumed.

It is desirable to provide hysteresis with switching between fuel cut off and resumption. That is, when a decision is made to resumes fuel supply after cut off, the load signal $S_2$ will be higher than the reference signal $S_5$ by a given value. If desired, it is possible to provide a lag between cutting off the fuel supply and its resumption fuel by varying constants for use in the arithmetic operations of the correction command generating circuit 8. By varying the points where the fuel is cut off or switched on and setting the latter point higher than the former, repeated cutting off and turning on of the fuel supply, which might cause passengers in the vehicle discomfort, can be effectively and satisfactorily prevented.

Figure 3:
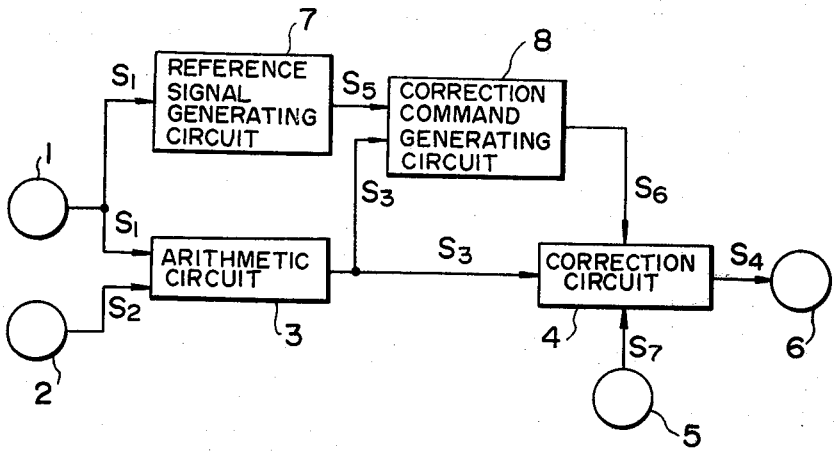
FIG. 3 is a schematic block diagram of a modification of the embodiment of FIG. 1.
Figure 4:
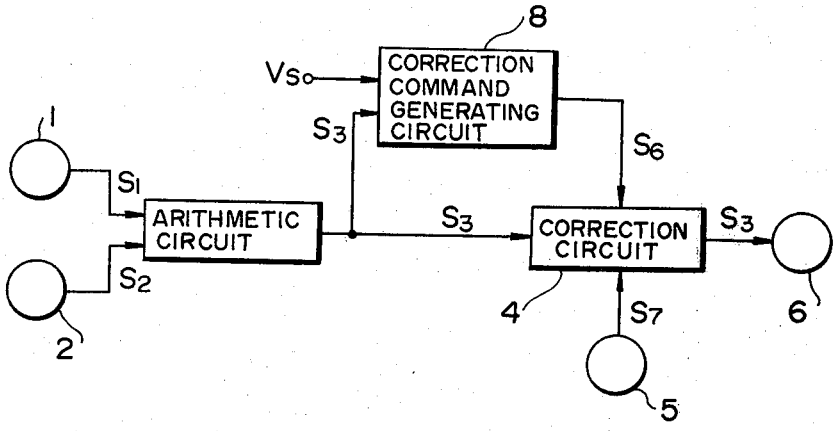
FIG. 4 is a schematic block diagram of another modification of the embodiment shown in FIG. 1.

FIGS. 3 and 4 illustrate modifications of the fuel supply control system of the above discussed first embodiment according to the present invention. As seen from FIGS. 3 and 4, the structures of these system are substantially the same as the control system of FIG. 1 in their general components, i.e. the engine speed sensor 1, engine load sensor 2, arithmetic circuit 3, correcting circuit 4, the other sensors 5 and the correction command generating circuit 8.

In FIG. 3, the specific concept of the present modification of the first embodiment is that the basic signal $S_3$ of the arithmetic circuit 3 is replaced by the engine load signal $S_2$ to be compared with the reference signal $S_5$ generated in the reference signal generating circuit 7 based on the engine speed signal $S_1$. Here, as stated above, the basic signal $S_3$ is determined by Q/N and therefore, is proportional to the air intake amount. This means the basic signal $S_3$ depends on the air intake amount and also corresponds to the engine torque. Therefore, the engine torque can be determined from the basic signal $S_3$. As seen from FIG. 2, since the relationship between the air intake amount Q and the engine speed N is represented by a substantially linear curve, Q/N will be substantially constant. Therefore, the basic level for determining whether the vehicle is decelerating or accelerating will be substantially constant.

If the basic level for determining whether the engine driving condition is decelerating or accelerating, is constant, the reference signal generating circuit can be omitted, as shown in FIG. 4. In this case, a constant signal $V_s$ will be inputted constantly to the correction command generating circuit 8. If the basic level is not constant but the varies substantially over a narrow range, the reference signal generating circuit will be required in the system. However, the structure of the reference signal generating circuit can be made simple.

It should be noted that, although hereinabove disclosed are embodiments employing a sensor for determining the engine load and using a sensor signal indicative of the air intake amount as the engine load signal, it will be possible to employ other embodiments. For example, it is possible to use an intake vacuum sensor for determining the engine load condition. If the intake vacuum sensor is used as an engine load sensor, the reference signal generating circuit can also be made simple in structure. Further, the basic signal indicative of the basic fuel supply amount need not always be determined by the air intake amount Q and the engine speed N. The basic signal can be determined otherwise. For example, with the air intake amount Q, a fuel injection interval can determine the basic signal, if the fuel is injected at a given constant interval.

In case of an air/fuel ratio control system for an internal combustion engine where the fuel injection amount is controlled according to the concentration of oxygen in the exhaust gas by measuring the concentration with an oxygen sensor provided within the exhaust gas passage, the basic signal will be determined according to the oxygen sensor signal. Therefore, by using the basic signal corrected according to the oxygen concentration in the exhaust gas to determine deceleration and acceleration of the vehicle, the decision to control the fuel supply amount will be more accurate and effective. On the other hand, in the feedback control system, it is necessary to distinguish the engine driving conditions to interrupt feedback control when the fuel supply system is increasing or decreasing the fuel amount or shutting off the fuel supply. In this case, it is possible to carry out feedback control only when the correction rate of the correction command generated in the fuel supply control system according to the present invention is 1.0, for correction by multiplication, or is 0, for additive correction. It is also possible to provide a given range about the correction rate to carry out feedback control. Namely, in case of accelerating and decelerating the engine and thereby varying the coefficient from 1.0, when the coefficient becomes 1.05 or 0.95, feedback control of the air/fuel ratio corresponding to oxygen concentration in the exhaust gas is interrupted. On the other hand, when the coefficient indicated for correction command, as generated by the correction command generating circuit 8 approaches to 1, i.e. either exceeds 0.93 or decreases below 1.03, feedback control of the air/fuel ratio is carried out. Thereby, hysteresis is provided to feedback control the air/fuel ratio of the internal combustion engine. Therefore, it becomes unnecessary to provide any other means for testing the engine driving condition as to whether feedback control should be carried out. Further, it is possible to provide a given suitable time lag for switching control operation between feedback control and open loop control for preventing the control operation from frequently changing in response to changes in driving conditions of the engine within a short period of time, for example during gear change operation. Generally, a time lag can be provided by providing hysteresis in the control system.

Figure 5:
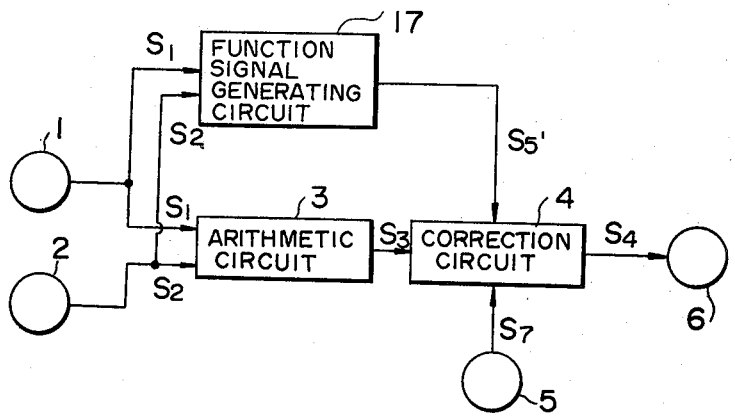
FIG. 5 is a schematic diagram of another embodiment of a fuel supply control system according to the present invention.

Referring now to FIG. 5, there is illustrated another embodiment of the fuel supply control system according to the present invention. In the shown embodiment as described hereafter, the structure of the control system is substantially the same as the preceeding embodiment, in general. For simplification of explanation, the elements or features of substantially the same functions are represented by the same reference numerals. In FIG. 5, the engine speed signal $S_1$ generated by the engine speed sensor 1 such as crank angle sensor, is fed to the arithmetic circuit 3. At the same time, the engine speed signal $S_1$ is also fed to a function signal generating circuit 17. The engine load signal, $S_2$ a signal indicative of the engine load such as air intake amount and generated by the engine load sensor 2 such as an air flow meter, is also fed to the arithmetic circuit 3 and the function signal generating circuit 17. Based on the engine speed signal $S_1$ and the engine load signal $S_2$, the arithmetic circuit 3 determines a basic fuel amount to be supplied to the engine and generates a signal $S_3$ having a pulse width corresponding to the determined basic fuel amount (hereinafter referred as "basic signal"). The basic signal $S_3$ is fed to the correction circuit 4 in which the pulse width of the basic signal is corrected based on the other control parameters such as the engine coolant temperature signal $S_6$ fed from sensors 5 such as engine coolant temperature sensor.

Meanwhile, the function signal generating circuit 17 generates a signal $S_5$ (hereinafter referred to as "function signal") which has given a functional relationship to both inputs, i.e. the engine speed $S_1$ and the engine load signal $S_2$. The functional signal $S_5$ indicates a engine driving condition in which the fuel amount is to be increased or decreased or fuel supply is to be shut off and is fed to the correction circuit 4. In response to the functional signal $S_5$, the correction circuit determines the fuel amount and generates a pulse signal having a pulse width corresponding to the fuel amount to be supplied to the engine.

Figure 6:
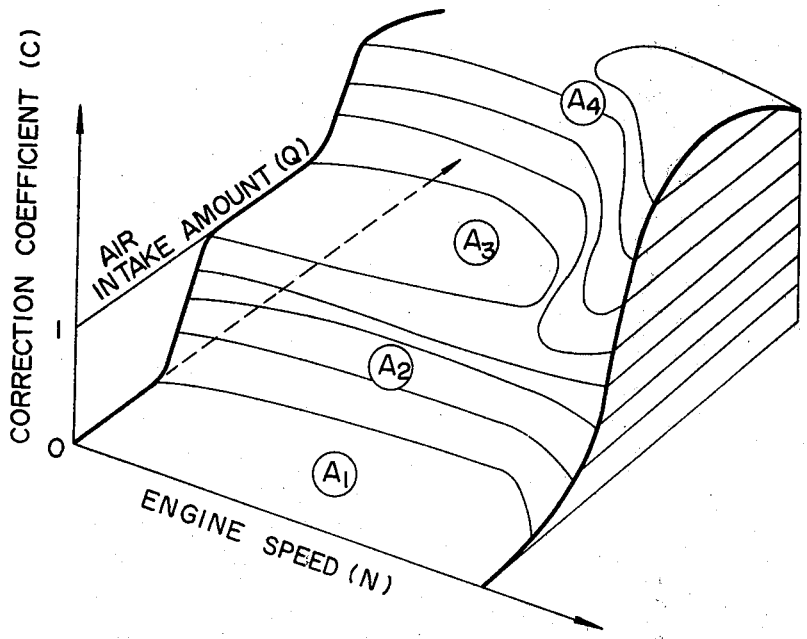
FIG. 6 is a three-dimensional graph illustrating relationship between the air intake amount, engine speed and correction rate for correcting the basic fuel supply amount.

FIG. 6 shows characteristics of the function signal generating circuit 7 wherein C represents a correction coefficient having a given functional relationship with the inputs of the function signal generating circuit, i.e. the engine speed signal $S_1$ indicating the engine speed N and the engine load signal $S_2$ indicating air intake amount Q. Further in FIG. 6, $A_1$ ($C=0$) represents a range to shut off fuel supply, $A_2$ ($0<C<1$) represents a range to decrease fuel amount, $A_3$ ($C=1$) represents a range not to correct the basic fuel amount and $A_4$ ($C>1$) represents a range to increase fuel amount. Although such a function signal generating circuit can be formed by an analog circuit, it is preferable to implement the same by using a digital computer which makes the operation easy and simple by using a table maybe look-up. In the computer system, a table used including data representing correction coefficients in each address of a memory unit thereof and the address can be identified by the inputs thereof. In this system, the function signal generating circuit 7 determines correction coefficients by a look-up in the table stored in the memory based on the engine speed N and the engine load Q.

As will be well known, in the table, each address for storing the correction coefficients is identified by the engine speed and the engine load plotted at given intervals. If the inputs, i.e. the engine speed signal $S_1$ and the engine load signal $S_2$ are values intermediate between prestored values of addresses, interpolation from four prestored values close to the input values may be used. Of course if one of the inputs only is an intermediate value, the interpolation is carried out with respect to two corresponding prestored values. When a digital computer is used as the function signal generating circuit, other circuits forming part of the fuel supply control system according to the present invention, e.g. the arithmetic circuit 3, or correction circuit 4 can also be embodied by the same computer. In this case, determining the basic fuel amount and correction rate of the basic fuel amount can be carried out by executing a program or programs stored in the memory unit thereof.

Figure 7:
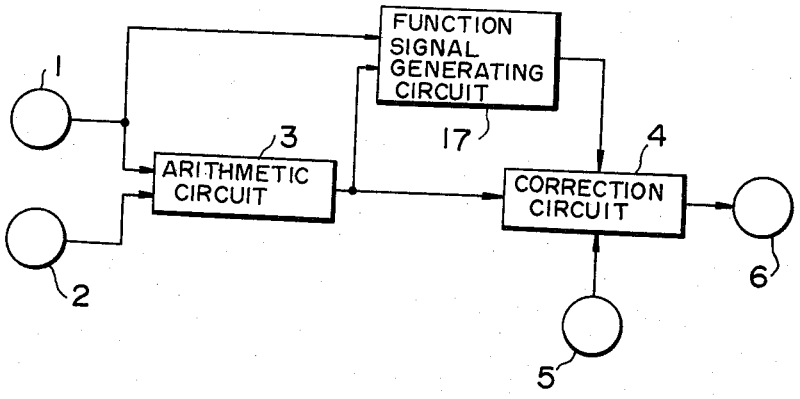
FIG. 7 is a schematic block diagram of a modification of the embodiment shown in FIG. 5.

By the implementation of a fuel supply control system according to the present invention, it is possible to change the level for determining whether the engine driving condition is adapted to shut off the fuel supply, corresponding to other control parameters such as the engine coolant temperature, vehicle speed or exhaust gas temperature and so on, by varying characteristics of the function signal generating circuit or comparator circuit. In this system, the engine driving condition can also be distinguished according to changes of transmission gear position, starting of the engine, substantially low engine speed and substantially low vehicle speed, which are inhibiting condition for shutting off the fuel supply. P FIG. 7 illustrates a modification of the embodiment of the fuel supply control system shown in FIG. 5. In this modification, the basic signal $S_3$ indicative of basic fuel amount and determined by the engine speed signal $S_1$ and the engine load signal $S_2$, is inputted to the function signal generating circuit 17. The function signal generating circuit 17 generates a functional signal $S_5$ based on the engine speed signal $S_1$ and the basic signal $S_3$. Here, since the basic signal $S_3$ is proportional to Q/N, the fundamental levels $L_1$ to $L_3$ for varying correction coefficients are substantially constant. Thus, the structure of the function signal generating circuit 17 can be made simple.

Likewise, the simplification of the structure of the function signal generating circuit 17 can also be achieved by use of a signal indicating an intake vacuum which is also substantially proportional to Q/N.

Thus, according to the present invention, a means for detecting deceleration of the vehicle, such as, for example, the throttle angle switch or accelerator pedal switch is no longer necessary, thus reducing costs and making it easier to adjust and maintain the vehicle. Further, the fuel supply control system according to the present invention can follow all the driving ranges of the internal combustion engine so that it can effectively and satisfactorily control fuel supply through all driving ranges in sequence.

In the fuel supply control system according to the present invention any suitable means such as air flow meter, intake vacuum sensor, throttle angle sensor, engine torque sensor and so on can be used for defining the engine load. This results in forming the fuel supply control system move easily.

Moreover, it is also possible to use correction coefficients determined by the present system for distinguishing feedback control conditions of fuel supply control based on the exhaust gas sensor signal.

The foregoing description of the invention has been presented for purposes of illustration and description. It is not intended to be exhaustive or to limit the invention to the precise forms disclosed, and obviously many modifications and variations are possible in light of the above teaching. The description was provided in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A fuel supply control system for an internal combustion engine, comprising:

first sensor means for detecting a load condition of an engine and generating a first sensor signal indicative of determined engine load;

second sensor means for detecting engine speed and generating a second sensor signal indicative of determined engine speed;

means for detecting an engine coolant temperature and producing a third sensor signal indicative of the determined engine coolant temperature;

arithmetic means for determining and producing a pulse signal having a pulse width indicative of a basic fuel supply amount determined based on said first and second sensor signal values;

third means for correcting said basic pulse width of said pulse signal based on said third sensor signal value; and a fourth means for distinguishing engine driving conditions and generating a correction command for effecting said third means to increase or decrease said basic pulse width of said pulse signal or to shut off fuel supply based upon a correction coefficient, said correction coefficient being variable depending upon said first and second sensor signal values, and being indicative of a fuel shut off condition when it is equal to or below a first predetermined value, and indicative of an engine driving condition requiring decreasing the fuel supply amount to decrease said basic fuel supply amount when said correction coefficient is in a range between said first predetermined value and a second predetermined value, and indicative of an engine driving condition requiring increasing the fuel supply amount to increase said basic pulse width when said correction coefficient is equal to or above said second predetermined value.

2. A control system as set forth in claim 1, wherein said fourth means for distinguishing engine conditions compares said first sensor signal with a predetermined reference signal to determine said correction command indicative of correction coefficient.

3. A control system as set forth in claim 2, wherein said reference signal is variable corresponding to said second sensor signal.

4. A control system as set forth in claim 1, wherein said fourth means compares said first sensor signal with a predetermined reference signal and wherein said first predetermined value is 0 and said second predetermined value is 1.

5. A control system as set forth in claim 4, wherein said reference signal is variable corresponding to said second sensor signal.

6. A control system as set forth in claim 4 or 5, wherein said reference signal is varied in proportion to said second sensor signal.

7. A control system as set forth in claim 1, wherein said fourth means compares said pulse signal indicative of the basic fuel supply amount with a reference signal and wherein said first predetermined value is 0 and said second predetermined value is 1.

8. A control system as set forth in claim 7, wherein said reference signal is constant.

9. A control system as set forth in claim 1, wherein said fourth means determines correction coefficient based on said first sensor signal and said pulse signal and said third means is operable to increase said pulse width of said pulse signal to increase fuel supply amount, when said correction coefficient of said correction command is larger than 1 as said second predetermined value, to decrease said pulse width to decrease fuel supply amount when said correction coefficient is between 1 and 0 as said first predetermined value, and to shut off fuel supply when said correction coefficient is equal to 0.

10. A control system as set forth in claim 9, wherein said fourth means is a microcomputer including a memory unit in which is stored data table identifying a correction coefficient with a value of said first and second sensor signal.

11. A control system as set forth in claim 10, wherein said microcomputer is operable to arithmetically determine said basic pulse signal and to determine a correction rate for correcting said basic pulse signal based on said data table.

12. A control system as set forth in any one of claims 4, 5, 7, 8, 9, 10 or 14 inclusive, wherein said correction command generated in said fourth means is applicable to a feedback control system of the internal combustion engine and when the correction coefficient indicated in said correction command is other than 1, feedback control is interrupted.

13. A control system as set forth in any one of claims 4, 5, 7, 8, 9, 10 or 14 inclusive, wherein said correction command generated in said fourth means is applicable to feedback control system for feedback controlling air/fuel ratio of the internal combustion engine and when the correction coefficient indicated in said correction command is varied from 1 at a first given rate, feedback control of air/fuel ratio is interrupted and when the correction coefficient accesses to 1 exceeding to a second give rate, feedback control is carried out.

14. A control system as set forth in claim 13, wherein said first given rate is 0.5% and said second given rate is 0.3%.

15. A fuel supply control system for an internal combustion engine, comprising:

first sensor means for detecting load condition on the engine and producing a first sensor signal indicative of the detected engine load;

second sensor means for detecting an engine revolution speed and producing a second sensor signal indicative of the detected engine revolution speed;

arithmetic means for determining a basic fuel supply amount based on said first and second sensor signals and producing a pulse signal having a pulse width representative of the determined basic fuel supply amount;

correction signal generator, responsive to said pulse signal and said second sensor signal, for determining a correction coefficient for correcting said basic fuel supply amount based on said pulse signal and said second sensor signal and producing a correction command representative of the determined correction coefficient; and correction means, responsive to said correction command, for distinguishing the engine condition depending upon the value of said correction command to correct the basic fuel supply amount by the correction coefficient indicated by said correction command when said correction command value is above a first predetermined value and to cut off fuel supply if the correction coefficient is equal to or below said first predetermined value.

16. A control system as set forth in claim 15, which further comprises third sensor means for detecting an engine coolant temperature and producing a third sensor signal representative of the detected engine coolant temperature, and said correction means is responsive to said third signal to correct said basic fuel supply amount based thereon.

17. The control system as set forth in claim 15 or 16, wherein said correction means corrects said basic fuel supply amount to decrease said pulse width when said correction command value is in a range between said first predetermined value and a second predetermined value, and to increase said pulse width when said correction command value is above said second predetermined value.

18. The control system as set forth in claim 17, wherein said first and second predetermined values are respectively constant.

* * * * *